United States Patent [19]

Feldman

[11] Patent Number: 5,026,105

[45] Date of Patent: Jun. 25, 1991

[54] HAND GRIP FOR CARRYING LOADED PLASTIC BAGS

[76] Inventor: Lennard Feldman, 6658 Via Regina, Boca Raton, Fla. 33433

[21] Appl. No.: 289,779

[22] Filed: Dec. 27, 1988

[51] Int. Cl.[5] ..... A45C 13/26; B65D 33/06

[52] U.S. Cl. ..... 294/170; 383/13

[58] Field of Search ..... 294/170, 171, 158-160, 294/166; 383/13, 25

[56] References Cited

U.S. PATENT DOCUMENTS

| | | | |
|---|---|---|---|
| 645,317 | 3/1900 | Flanders | 294/170 |
| 759,056 | 5/1904 | Woodman | 294/170 |
| 3,251,622 | 5/1966 | Miller | 294/170 X |
| 3,262,727 | 7/1966 | Blackaby | 294/170 |

FOREIGN PATENT DOCUMENTS

| | | | |
|---|---|---|---|
| 552633 | 5/1923 | France | 294/171 |
| 2541099 | 8/1984 | France | 294/170 |
| 2132079 | 7/1984 | United Kingdom | 294/171 |
| 2153212 | 8/1985 | United Kingdom | 294/170 |

*Primary Examiner*—Margaret A. Focarino
*Assistant Examiner*—Dean J. Kramer

[57] ABSTRACT

A novel hand grip for carrying loaded plastic bags that are made of flexible plastic sheet material and have bag handles formed in the opposite walls thereof, includes an elongated yoke that is shaped to be grasped by a human hand, and at least two (2) longitudinally spaced-apart hooks attached to the yoke and positioned thereon for hanging the bags by the bag handles thereof when the grip is raised. The hooks are spaced apart on the yoke to permit the ring finger and middle finger of the hand to fit comfortably therebetween with the little finger and the index finger outboard of the hooks. Each of the hooks has a restricted access for passing bag handles into and out of the eye of the hook, whereby the bag handles may be captured in the eye of the hook and cannot be released inadvertently from the hook.

1 Claim, 3 Drawing Sheets

HAND GRIP FOR CARRYING LOADED PLASTIC BAGS

BACKGROUND OF THE INVENTION

1. Field of the Invention

This invention relates to a novel hand grip for carrying loaded plastic bags, and particularly to a hand grip which captures and holds temporarily the integral plastic handles of the bags.

2. Description of the Prior Art

Many retail establishments, especially supermarkets, provide inexpensive plastic bags into which the multiplicity of purchased articles are loaded and then transported. The bags are made of thin flexible plastic sheet material, and have an open side for loading the articles into the bag, and two (2) flexible handles formed in the bag walls at the open side of the bag, as by punching or blanking a handle opening into the bag walls.

The retail customer usually leaves the retailer with several bags held by the handles thereof grasped in one or both of his hands. The handles, of course, are made of the flimsy plastic sheet material of the bag and do not retain their shape, but conform to the shape of the customers' hands. Where the contents of a bag is heavy, there is considerable localized pressure across the customers hands.

U.S. Pat. No. 4,590,640 to R. W. Enersen illustrates such a bag and, to overcome the foregoing problem, provides a handle or hand grip comprising an elongated member that is shaped to be grasped by the hand of the customer. The elongated member has a longitudinal slot herein for receiving the handles of a bag. As the bag is being carried, the bag handles press down in the slot and the pressure thereof is distributed by the elongated member more evenly over the fingers of the hand. When the bags are set down, the handles may or may not pop out of the slot in the elongated member. Where the loaded bags may be hand-carried to an automobile, and stored there until they are again hand-carried from the automobile into a residence, it is desirable that the hand grip captures the bag handles and holds them temporarily until it is desired to release them.

Other hand grips disclosed, for example, in U.S. Pat. Nos. 3,912,140 to H. M. Franges; 3,913,172 to G. Richards; and 4,004,722, have longitudinal slots for receiving and holding rope handles of carrier bags therein. These latter hand grips involve complicated structures and generally are intended for use with a single bag or package and require a bendable plastic elongated member which is prone to breaking.

OBJECTS OF THE INVENTION

An object of this invention is to provide a novel hand grip for carrying one or more loaded plastic bags.

A further object is to provide a novel hand grip for the foregoing purposes which captures and holds the handles of plastic bags until it is desired to release the handles.

Another object is to provide a novel hand grip for the foregoing purposes which is particularly adapted for carrying a plurality of heavily-loaded plastic bags.

Still another object is to provide a novel hand grip for the foregoing purposes which has a simple, rugged structure and can be produced at a relatively low cost.

SUMMARY OF THE INVENTION

These and other objects of the invention can be realized with the novel hand grip described herein that is particularly adapted for carrying a plurality of loaded bags that are made of flexible plastic sheet material. The bags are of the type having an open side for loading and bag handles formed in opposite walls of the bags at the open ends.

The novel hand grip includes an elongated yoke that is shaped to be grasped by a human hand with the four (4) adjacent fingers thereof around and supporting the yoke. There are at least two (2) longitudinally spaced-apart hooks, and preferably two (2) longitudinally spaced-apart pairs of hooks that are also spaced-apart transversely. The hooks are attached to the yoke and positioned thereon for hanging said bags by the bag handles from the hooks when yoke is grasped by the hand and raised.

The at least two (2) hooks, or hook pairs, are longitudinally spaced apart on the yoke to permit the ring finger and adjacent middle finger of the grasping hand to fit comfortably therebetween, with the little finger and index finger of the hand outboard of the hooks, or hook pairs. The yoke may have finger-gripping undulations in the surface thereof. The yoke itself is preferably made of a compressible foam material for providing additional comfort in grasping the yoke and for carrying the yoke with loaded bags thereon.

Each of the hooks that is attached to the yoke has a restricted access for passing the bag handles thereon, whereby the handles are captured in the eye of the hook and are not released inadvertently from the hook. In one form, each hook comprises a shaft that defines a hook eye. The shaft has a proximal portion attached to and extending from the yoke, a distal portion and a central arcuate portion therebetween. The distal portion is adjacent to, either against or closely spaced from, the proximal portion, so that there is a narrow confined access into the eye of the hook. In a preferred usage, the bag handles are pushed through the access both into and out of the eye. Various configurations of hooks are possible, but all should have a restricted access to the eye of the hook.

The novel hand grip can be used to carry several loaded plastic bags at one time. When the hand grip with the bags attached thereto are set down on a support, the bag handles do not slip out of the hook eyes and the entire assembly may be again raised by the hand grip and carried elsewhere. The novel hand grip has a simple rugged structure with no moving parts to break or go out of adjustment. The simple rugged structure allows the novel hand grip to be produced at low cost. The novel hand grip takes advantage of the flimsy character of the bag handles to slip into and out of the hook eye and, conversely, to use the bag handles as a tether for the hand grip when it is connected to the bags.

DETAILED DESCRIPTION OF THE INVENTION INCLUDING THE PREFERRED EMBODIMENTS

Figure 1:
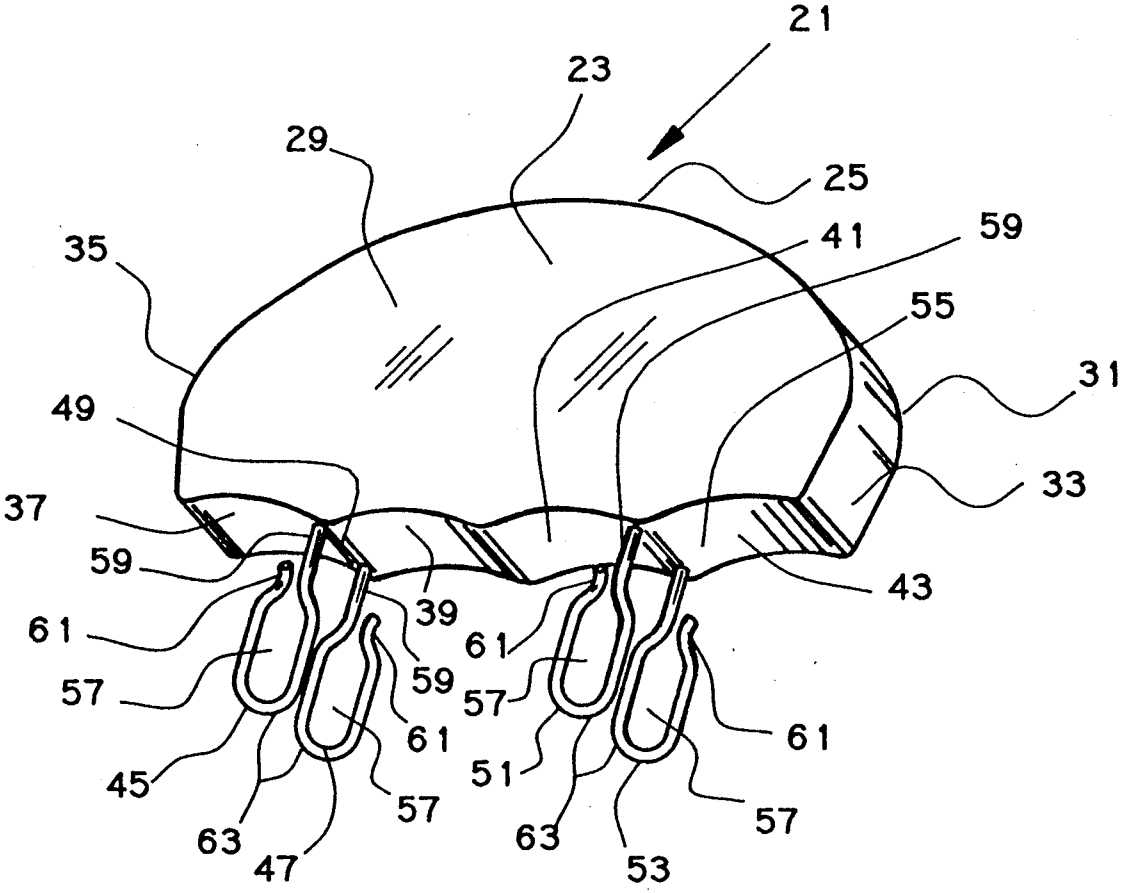
FIG. 1 is a perspective view of a first embodiment of the novel hand grip having hook pairs extending downward from the bottom surface of the yoke thereof.

The following description of some of the preferred embodiments of the concepts of this invention is made with reference to the accompanying figures. Where an individual structural element is depicted in more than one figure, it is assigned a common reference numeral for simplification of identification and understanding.

The first embodiment of the novel hand grip (21) shown in FIG. 1 comprises an elongated yoke (23) of a firm compressible closed-cell plastic foam. The yoke (23) is arcuate in shape and sized to fit in the grasp of a human hand (not shown). The yoke (23) has a top surface (25), a bottom surface (27), two (2) side surfaces (29 and 31) and two (2) end surfaces (33 and 35). The bottom surface (27) has a series of undulations including four (4) successive depressions (37, 39, 41 and 43) for receiving the index finger, the middle finger, the ring finger and the little finger of the human hand in that order or in the reverse order. The top surface is shaped to fit the palm of that hand.

A first pair of hooks (45 and 47) are attached to the yoke (23) in transversely-spaced positions on the rise (49) between the first and second depressions (37 and 39). A second pair of hooks (51 and 53) are attached to the yoke (23) in transversely-spaced positions on the rise (55) between the third and fourth depressions (41 and 43). The first hook pair (45 and 47) is longitudinally spaced from the second hook pair (51 and 53) to permit the middle finger and the ring finger of the grasping hand (not shown) to fit comfortably therebetween with the index finger and the little finger of the hand outboard of the hook pairs. The elongated member (23) and the positions of the hooks (45, 47, 51 and 53) attached thereto is entirely symmetrical and therefore can be grasped as described with either a left hand or a right hand, with the fingers of the hand entering from either side (29 and 31).

Each hook comprises a shaft that defines a hook eye (57). The shaft includes a proximal portion (59) attached to and extending from the elongated member (23), a distal portion (61) and a curved central portion (63) therebetween. The distal portion (61) is adjacent to, either touching or closely spaced from the proximal portion (59) providing a limited access into and out of the eye (57).

To use the novel hand grip shown in FIG. 1, a plurality, for example four (4), of plastic bags (not shown) are loaded with various articles and placed side by side. The handles of one bag are slid through the limited access into the eye (57) of each hook (45, 47, 51 and 53). After entering the eye (57), the handle expands and thereby becomes captured in the eye (57) of the hook. The hand grip (21) may now be raised, thereby lifting the bags off their support whereby the bags hang by their handles from a hook. The assembly of hand grip (21) and bags may be transported to an intermediate support, such as the floor of the trunk or cabin of an automobile, where the assembly can be rested. The assembly can later be raised and carried by the novel hand grip (21) without fear that any of the handles have slipped out of or off any of the hooks. To remove the handles of a bag from a hook, the handle must be grasped firmly and pushed through the limited access to the eye of the hook. Where the distal portion of the hook is touching the proximal portion, the shaft of the hook has sufficient spring that the bag handles can be pushed into and out of the eye (57).

Figure 2:
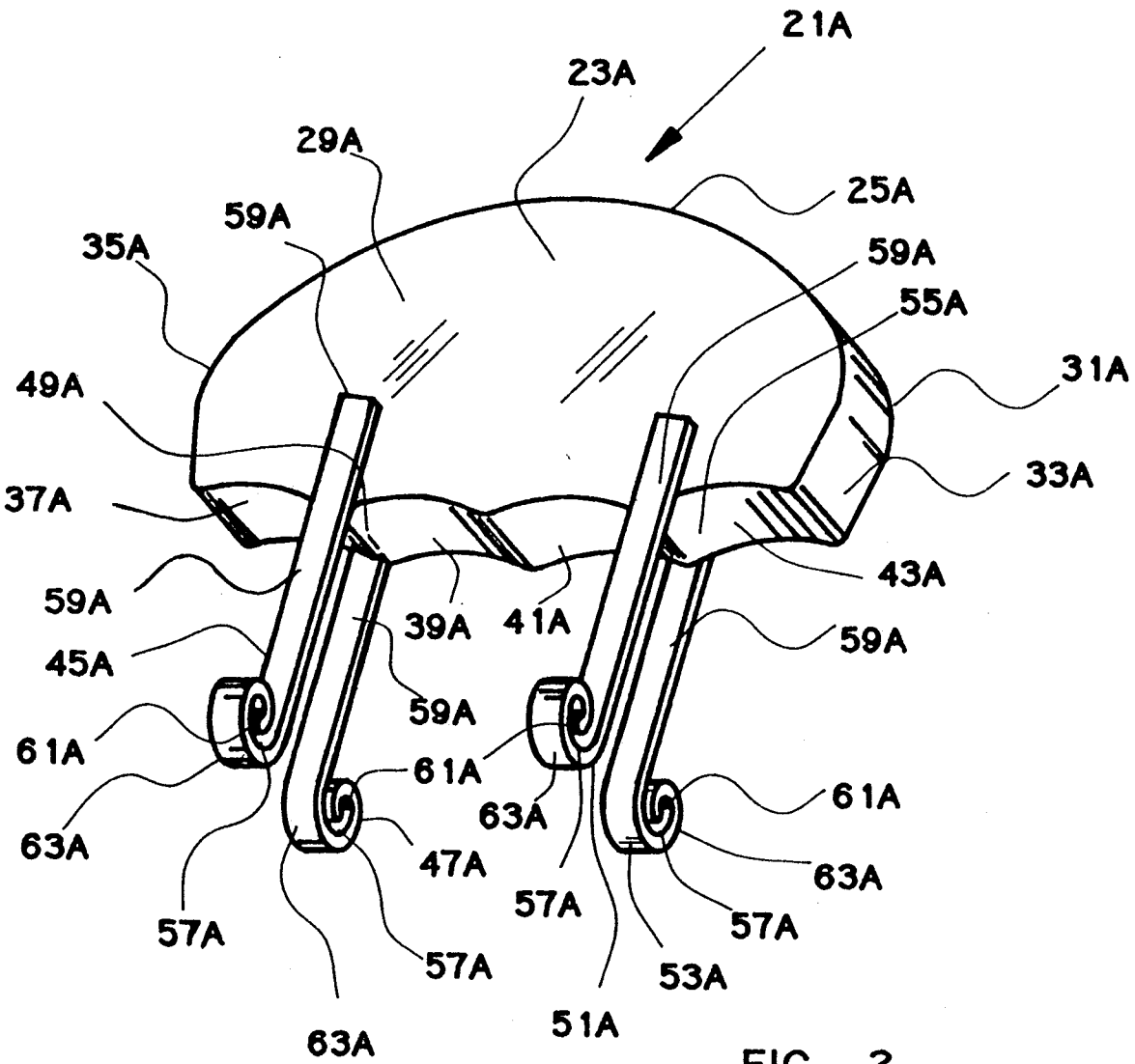
FIG. 2 is a perspective view of a second embodiment of the novel hand grip having hook pairs extending downward from the opposite side surfaces of the yoke thereof.

FIG. 2 shows a second embodiment (21A) of the novel hand grip that is similar in construction to the first embodiment (21), except that the hooks (45A, 47A, 51A and 53A) have a different configuration and are mounted from the sides (25A and 29A) of the elongated member (23A). Hence, parts with similar functions bear the same reference numerals followed by the letter "A". The hooks (45A, 47A, 51A and 53A) are strap-like with substantially rectangular cross-sections. As in the first embodiment of FIG. 1, the hooks extend downward and the open sides of the hooks with the limited accesses to the eyes (57A) all face sideward. Also, it is noteworthy that the distal ends (61A) of the hooks in the second embodiment bend inward into the eyes (57A), whereas in the first embodiment the distal ends (61) bend outward away from the eyes (57) of the hooks (45, 47, 51 and 53).

Figure 3:
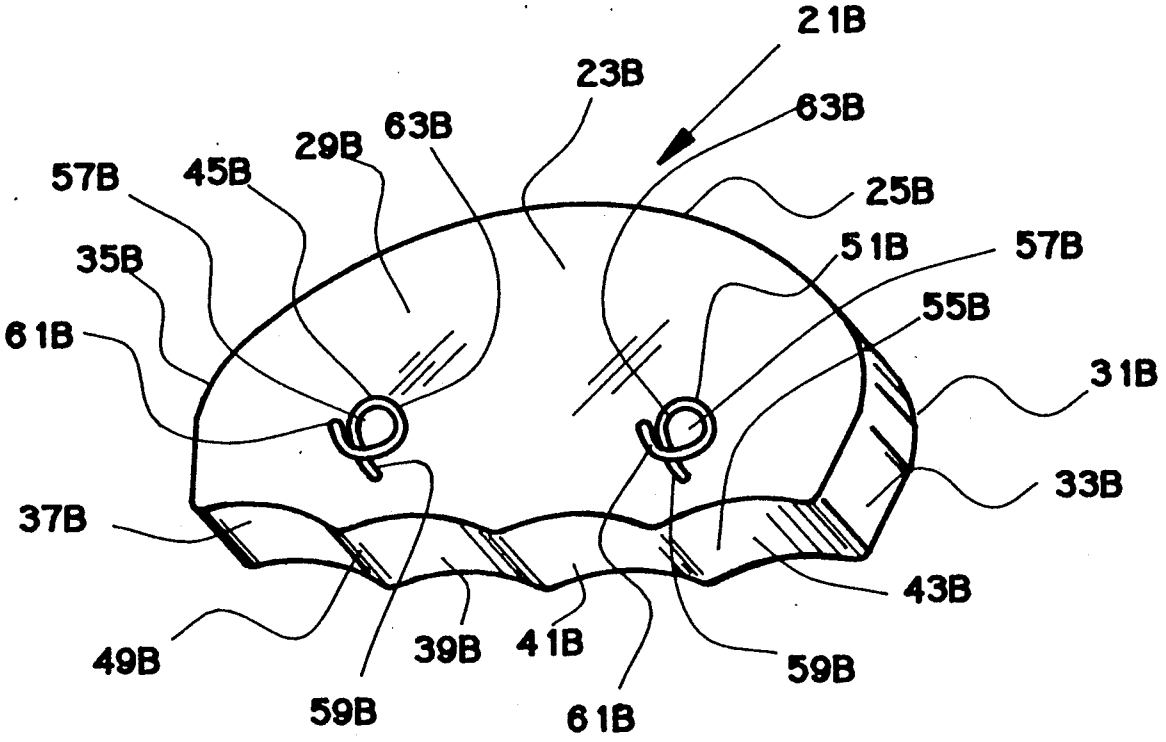
FIG. 3 is a perspective view of a third embodiment of the novel hand grip having hook pairs extending sideward from the opposite side surfaces of the yoke thereof.

FIG. 3 shows a third embodiment (21B) of the novel hand grip that is similar in construction to the first embodiment (21), except that the hooks (45B, 47B, 51B and 53B) have a different configuration, are mounted from the side (25B and 29B) of the elongated member (23B), and extend sidewardly from the elongated member (23B). Hence, parts with similar functions bear the same reference numerals followed by the letter "B". The hooks (45B, 47B, 51B and 53B) are wire-like with substantially round cross-sections. Unlike the first embodiment, the hooks extend sideward from each side into a spiral with the open sides facing upward. Adjacent portions of the distal ends (61A) and the central portions (63B) are closely spaced to form the limited access into and out of the eyes (57B).

The foregoing figures and descriptions thereof are provided as illustrative of some of the preferred embodiments of the concepts of this invention. While these embodiments represent what is regarded as the best modes for practicing this invention, they are not intended as delineating the scope of the invention, which is set forth in the following claims.

What is claimed is:

1. A hand grip for carrying a plurality of loaded bags made of flexible plastic sheet material, each of said bags having an open side for loading articles into said bag and flexible plastic bag handles formed in the opposite walls of said bag at said open side, said hand grip comprising and elongated yoke shaped to be grasped by a human hand with the four adjacent fingers therefore around said yoke, said yoke having opposite side surfaces, opposite end surfaces, a top surface and a bottom surface, said bottom surface having finger-gripping undulations therein, and four symmetrically-spaced hooks attached to said yoke and positioned to hang said bags from said hooks when said yoke is grasped by and supported by said hand, each of said hooks being spaced inwardly from said end surfaces so that at least one gripping undulation is positioned between each said hook and the nearest end surface, said hooks being positioned in transversely spaced-apart pairs, said pairs of hooks being longitudinally spaced-apart to permit the ring finger and middle finger of said hand to fit comfortably therebetween, with the little finger and index finger of said hand outboard of said hooks when said yoke is grasped by said hand, each of said hooks attached to and extending downwardly from respective said side surfaces of said yoke, and each of said pair of hooks having oppositely directed hook openings for receiving said bags, each of said hooks having a restricted means for sliding the handles of one of said bags onto and off of a hanging positions on said hook.

* * * * *